US009396714B1

(12) United States Patent
Morong

(10) Patent No.: US 9,396,714 B1
(45) Date of Patent: Jul. 19, 2016

(54) GRAVIMETER-BASED MUSICAL-INSTRUMENT SWELL, EXPRESSION, OR CRESCENDO PEDAL

(71) Applicant: William Henry Morong, Paoli, PA (US)

(72) Inventor: William Henry Morong, Paoli, PA (US)

( * ) Notice: Subject to any disclaimer, the term of this patent is extended or adjusted under 35 U.S.C. 154(b) by 0 days.

(21) Appl. No.: 14/740,180

(22) Filed: Jun. 15, 2015

(51) Int. Cl.
*G10H 1/32* (2006.01)
*G10H 3/00* (2006.01)
*G10H 1/34* (2006.01)

(52) U.S. Cl.
CPC ..... *G10H 1/34* (2013.01); *G10H 2220/395* (2013.01)

(58) Field of Classification Search
CPC ..... G10H 2220/395; G10H 1/34
USPC ..... 84/746
See application file for complete search history.

(56) References Cited

U.S. PATENT DOCUMENTS 3,159,706 A * 12/1964 Leslie ..... G10H 1/04 84/701
4,361,069 A * 11/1982 Peterson ..... G10B 3/16 84/346
4,491,050 A * 1/1985 Franzmann ..... G10C 3/14 84/746
8,338,689 B1 * 12/2012 Beaty ..... G10H 1/0091 84/718
2009/0314156 A1 * 12/2009 Komatsu ..... G10H 1/346 84/626
2010/0175544 A1 * 7/2010 Ikeya ..... G10H 1/348 84/746
2010/0236388 A1 * 9/2010 Komatsu ..... G10H 1/346 84/626
2011/0271820 A1 * 11/2011 Cockerell ..... G10H 1/348 84/746
2012/0031253 A1 * 2/2012 Yoshino ..... G10D 13/006 84/422.1
2012/0073425 A1 * 3/2012 Hashimoto ..... G10H 1/348 84/746
2012/0222542 A1 * 9/2012 Hashimoto ..... G10H 1/348 84/746
2014/0102282 A1 * 4/2014 Yamane ..... G10D 13/024 84/422.1

* cited by examiner

*Primary Examiner* — Jeffrey Donels

(57) ABSTRACT

There is provided a swell or expression pedal for controlling swell shades of a pipe organ swell box or pipe chamber, audio level of a virtual pipe organ, or musical instrument expression, responsive to pedal angle relative to the force of the earth's gravity, responsive to pedal depression by a musician's foot. The musician depresses the pedal when additional sound is desired, or to engage different ranks of pipe sounds. As the pedal rotates through an angle, a gravimeter responds to the angular change of the force of gravity relative to it to produce an electrical signal, analog or digital, responsive to the angle of the pedal. This electrical signal may be used to actuate a swell shade motor, controlling sound emanation from a swell box or pipe chamber, to control the functions of a virtual pipe organ, or to control the expression of other musical instruments.

5 Claims, 7 Drawing Sheets

GRAVIMETER-BASED MUSICAL-INSTRUMENT SWELL, EXPRESSION, OR CRESCENDO PEDAL

STATEMENT REGARDING FEDERALLY SPONSORED RESEARCH OR DEVELOPMENT

The present invention was not developed with the use of any Federal Funds, but was developed independently by the inventor.

BACKGROUND OF THE INVENTION

Many pipe organs have some or all of their pipes enclosed in swell boxes or chambers. Such enclosures are provided with openings for the egress of sound, over which are often fitted swell shades. Swell shades are arrays of pivoted boards, like large venetian blinds, disposed either horizontally or vertically, to control the egress of pipe sounds. In ancient times such shades were often simple doors, and not instantly adjustable by an organist, but in recent centuries organs have been fitted with pedals, called swell or expression pedals, whereby the organist can control the egress of sound at will. Many organs have multiple swell pedals controlling plural swell boxes or pipe chambers. Additionally, many organs are fitted with other similar pedals, called crescendo pedals, usually located to the right of the swell pedals, for engaging additional ranks of organ sounds when a more comprehensive ensemble of sound is desired. For about eighty years, musical organs without pipes have also been made, which also comprise expression pedals that are analogous to the swell pedals of pipe organs. In recent decades, advances in digital technology have made practical virtual pipe organs. Virtual pipe organs usually comprise a computer and operate by playing in loops digital files called samples having been recorded from sounds of pipes of real organ pipes. Virtual pipe organs also comprise swell pedals like those of pipe organs, which pedals control, either digitally or by analog circuitry, the levels of the signals emanating from virtual pipe chambers comprising ranks of samples of recorded pipe sounds. Expression pedals to control volume or to invoke other musical effects, such as sustain pedals for virtual pianos, are often attached to other musical instruments.

DEFINITIONS

Gravimeter: A device that generates a signal that is responsive to the force of gravity.

Crescendo pedal, also known as a crescendo shoe, a pedal for engaging additional ranks of pipe organ sounds under the control of an organist. A crescendo pedal may be built like a swell pedal described below but may be applied differently.

Chamber: An enclosure with an opening, containing ranks of organ pipes, or a group of virtual organ pipe sound files, the sound level or signal level of either of which respectively may sometimes be controlled responsive to a swell or expression pedal.

Console: A part of a musical organ comprising one or more claviers for chromatic control, and other controls for adjusting its timbre and audible volume.

MIDI: Musical Instrument Digital Interface is a digital protocol commonly used to provide communication within and between musical instruments.

Musical effect: Manipulation of the function of a musical instrument to control volume, pitch, timbre, or amplitude envelope of sounds being produced.

Rank: A group (usually chromatic) of organ pipes or of pipe organ sounds of similar timbre that may be engaged responsive to a control manipulated by an musician or by an musician's assistant. A rank of pipes or pipe sounds controlled by a swell pedal is said to be "under expression."

Swell Box: A box, often free-standing, containing ranks of organ pipes to be controlled, as in a chamber.

Swell Pedal: Also known as an expression pedal, or as a swell shoe, a swell pedal is usually about the size of a human foot, and usually located approximately centered in an organ console, above a pedal clavier, and in front of a musician's toes, operated by foot.

Swell shades: A venetian-blind like assemblage of pivoted boards fitted to the opening of a chamber or swell box to control the egress of sound therefrom into a listening area, responsive to depression of a swell pedal.

Swell shade motor: A motor adapted to open or close swell shades responsive to the angle of a swell pedal. Swell shade motors are often sector-rotating and connected to the swell shades through a mechanical linkage, of which there are many varieties. A swell shade motor may be purely electrical, or may be pneumatic, usually under electrical control.

Virtual pipe organ: A musical instrument usually comprising a console similar or identical to that of a pipe organ, but usually lacking air-blown pipes, but instead comprising recorded audio files of air-blown pipes, called samples, usually played back in loops under computer control, responsive to signals from the console.

Relay: Apparatus for controlling an organ, responsive to signals from a console, for parsing, combining, and conditioning such signals to provide electrical and/or pneumatic drive to control air-blown organ pipes and other organ components such a swell motors. Sometimes a relay is comprised by a console. A relay may comprise a computer fitted with computer peripheral apparatus for receiving signals from a console and for driving such devices as swell motors. In a virtual organ such a computer may control only electrical signals that represent sounds of actual air-blown pipes.

USB: Universal Serial Bus is a digital protocol used for innumerable purposes, among them communication within and between musical instruments.

DESCRIPTION OF THE PRIOR ART

Organ consoles have long been fitted with swell pedals for controlling swell shades. Mechanical and pneumatic controls have been used. In the last century electrical swell pedal controls became common. Exemplary prior-art electrical swell and crescendo pedal assemblies are offered by Peterson Electro-Musical Products, Inc. of Alsip, Ill. The Peterson offerings are usually fitted with either arrays of reed switches or with potentiometers. Organ Supply Industries of Erie, Pa. offers several varieties prior-art pedal angle sensors called swell rollers. A swell roller comprises a wooden cylinder mounted on an axis, fitted with a pivot arm that is usually attached through a connecting rod to a swell pedal. Rocking motion of the pedal causes slight rotation of the cylinder. The cylinder is fitted with a helically disposed electrical contact. Fixed parallel to the cylinder axis is a wooden bar penetrated by a multiplicity of contact wires that electrically contact the contact on the cylinder. Rotation of the cylinder causes progressive connection between the fixed contact wires and the helical contact on the cylinder. This apparatus forms a single-pole multi-throw progressively-shorting electrical switch responsive to the rocking motion of the swell pedal. Resistors may be attached to this switch to form a rheostat or a potentiometer for controlling a swell shade motor. Organ Supply Industries offers swell rollers with between 6 and 75 contact wires. Such prior art swell pedal angle sensors are mechanically complex and subject to wear.

In virtual organs, pedal controllers, usually analog to digital MIDI encoders, commonly provide one or more sets of three terminals for attachment of potentiometers or swell rollers arranged as described above, in which case a computer having the controller as a peripheral performs in software the function corresponding to the swell shade function of a real pipe organ.

For instruments other than organs, a plethora of expression pedals using switches and or potentiometers are used to control numerous musical effects, for example sustain pedals of virtual pianos.

BRIEF DESCRIPTION OF THE INVENTION

In an embodiment of the present invention a gravimeter is fitted to a swell shoe of an organ. As the swell shoe is depressed, the angle changes between the gravimeter and an imaginary line proceeding radially from the center of the earth, the direction of the force of the earth's gravity. The gravimeter generates one or more electrical signals which are responsive to its angular position relative to the force of gravity. With the gravimeter attached to a swell or expression pedal, these signals respond to angular position of the pedal as it is depressed. The gravimeter signals provide signals responsive to that angular position, which may be analog, digital, or both, depending on the gravimeter chosen. Gravimeter signals may be conveyed to an organ relay, which in turn may provide drive signals, electrical or pneumatic, to actuate swell shades responsive to a musicians foot motion.

Alternatively, for electronic organs, including virtual organs, the swell shade function may be performed digitally or by analog circuitry responsive to the pedal angle of the swell or expression pedal. The present invention may be embodied as a free-standing expression pedal for musical instruments other than organs.

DETAILED DESCRIPTION OF THE INVENTION

Figure 1B:
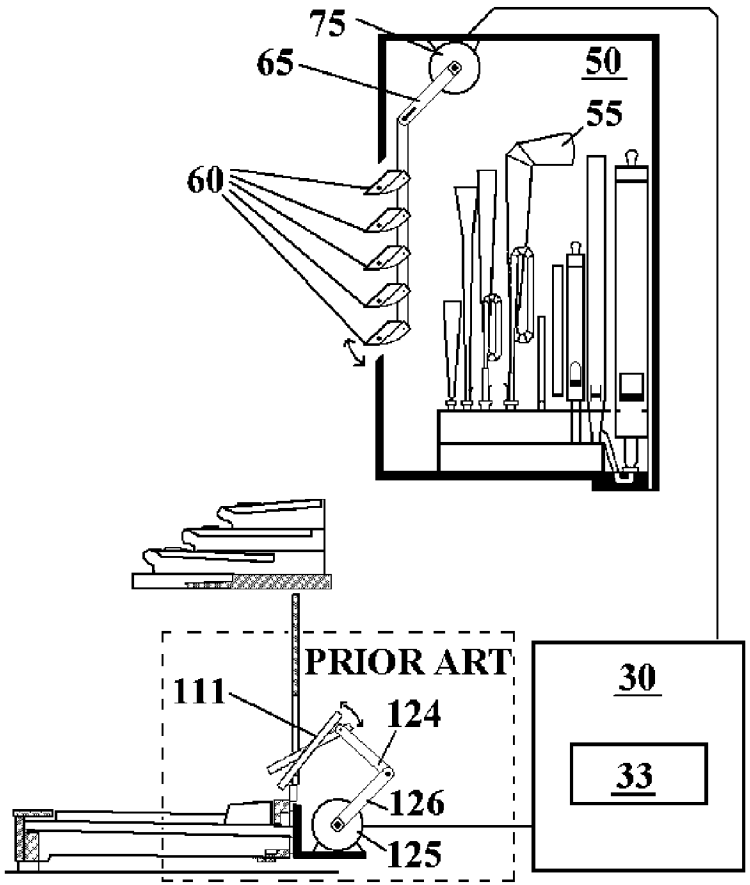
FIG. 1B shows a partial section of the console with a prior-art linkage and a prior art pedal angle sensor. Also shown are a relay, and a swell box with pipes, as swell motor, a linkage, and swell shutters.
Figure 1A:
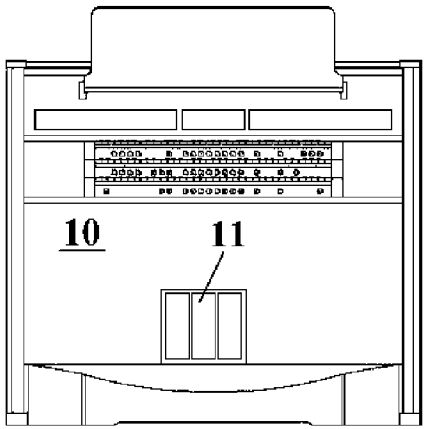
FIG. 1A shows an organ console having swell pedals.

FIG. 1A shows an organ console 10, having swell pedals 11. Typically an organist sits on a bench and, with his or her feet, operates one or more swell pedals 11 to control swell shades on one or more swell boxes, both to be described below.

FIG. 1B shows a cut-away side view of an organ console having a prior-art swell pedal 111 that an organist depresses with the feet, typically rocking pedal 111 through an angle of about 22 degrees. The foot-contacting and pivoting parts of swell pedal 111 may be the same as a swell pedal according to the present invention, but there the similarity stops. Unlike a swell pedal according to the present invention, swell pedal 111 operates a prior-art linkage 124, which in turn rotates an arm 126 of a prior-art swell roller 125. Swell roller 125 is a multi-throw electrical switch that may have between 6 and 75 positions to provide an electrical signal responsive to the position of swell pedal 111. Swell roller 125 may be replaced with a linear potentiometer mechanically connected to linkage 124, or with a rotary potentiometer fitted with an arm as is swell roller 125. The swell roller 125, or its substitute, is connected to organ relay 30. Organ relay 30 may comprise an analog circuitry capable of processing the swell roller signal and circuitry driving a swell motor 75, or may comprise an analog to digital potentiometer encoder attached to a computer 33 comprised by relay 3, the latter comprising a suitable driver to operate swell motor 75. Thus the organist playing an air-blown organ controls the sound of organ pipes 55, contained in swell box 55 and controlled by swell motor 75, opening or closing swell shades 60, activated by linkage 65. In a virtual organ, the organist operates the swell pedal to control virtual ranks of pipe sounds that reside in sound sample files usually having been installed in computer 33 comprised by relay 30 along with other software usually also installed in computer 33 to emulate all the functions of an air-blown organ. Details of virtual organ operation are too complex to be discussed in this teaching. With either an air-blown or virtual organ, pedal 111 operates a relatively complex prior-art linkage and swell roller, a potentiometer, or some similar electromechanical device that is subject to wear, may be affected by dirt, and may be difficult to adjust to obtain and maintain proper operation. Very often mechanical consideration limit the rotation or travel of potentiometers used as swell pedal sensors which may ill-affect their resolution and/or make them noisy.

Figure 2:
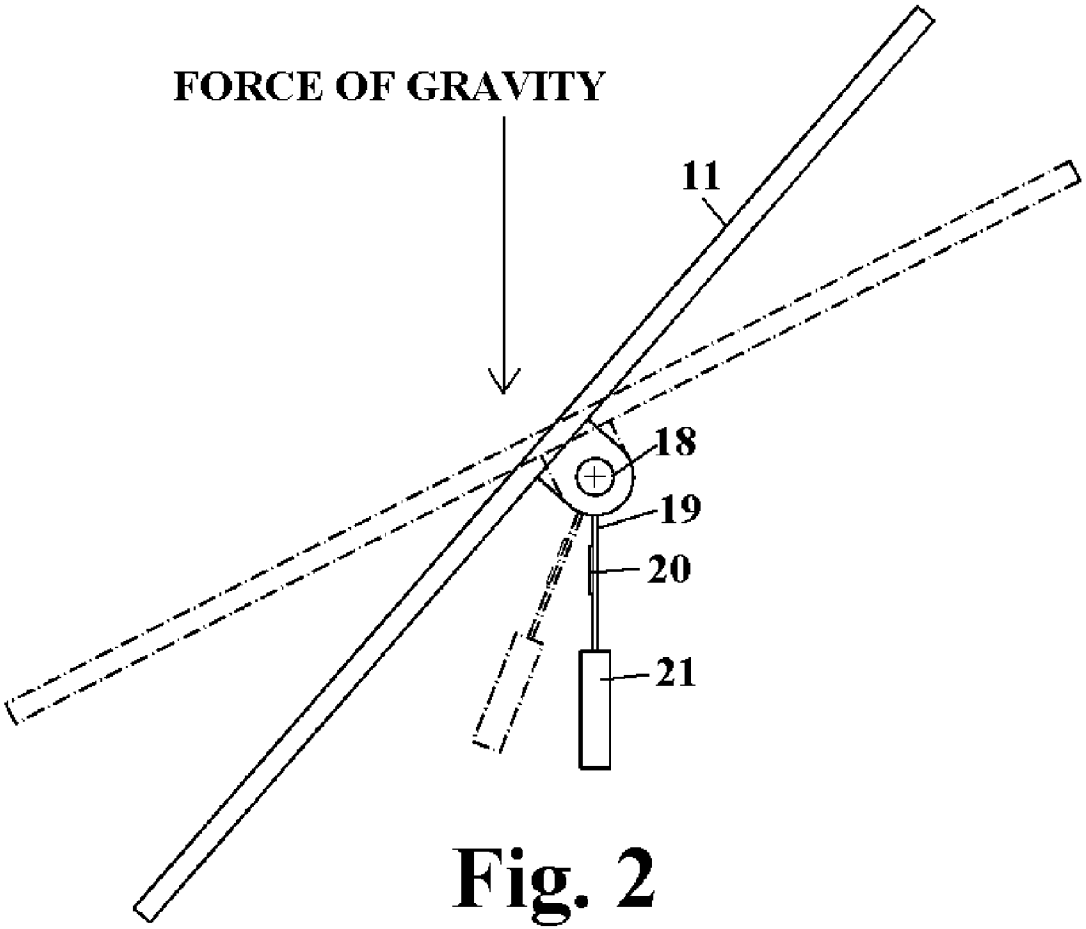
FIG. 2 shows a swell, expression, or crescendo pedal according to the present invention comprising a simple gravimeter.

FIG. 2 shows a swell pedal 11 according to the present invention comprising a primitive spring-type gravimeter. This gravimeter typically comprises a thin, flat metal spring 19 attached to the pedal 11 to which is fitted a thin strain gauge 20. Also attached to the spring is a weight 21. When pedal 11 is at rest, weight 21 pulls directly down on spring 19, causing little or no flexure of spring 19. However when pedal 11 is depressed, rotating about pivot 18, it lifts weight 21, causing spring 19 to be flexed. This flexure also flexes strain gauge 20 causing it to generate a signal responsive to the depression of pedal 11. One of many suitable strain gauges for this application would be model SGD-7/1000-DY11 offered by OMEGA Engineering, INC. of Stamford, Conn.

Figure 3:
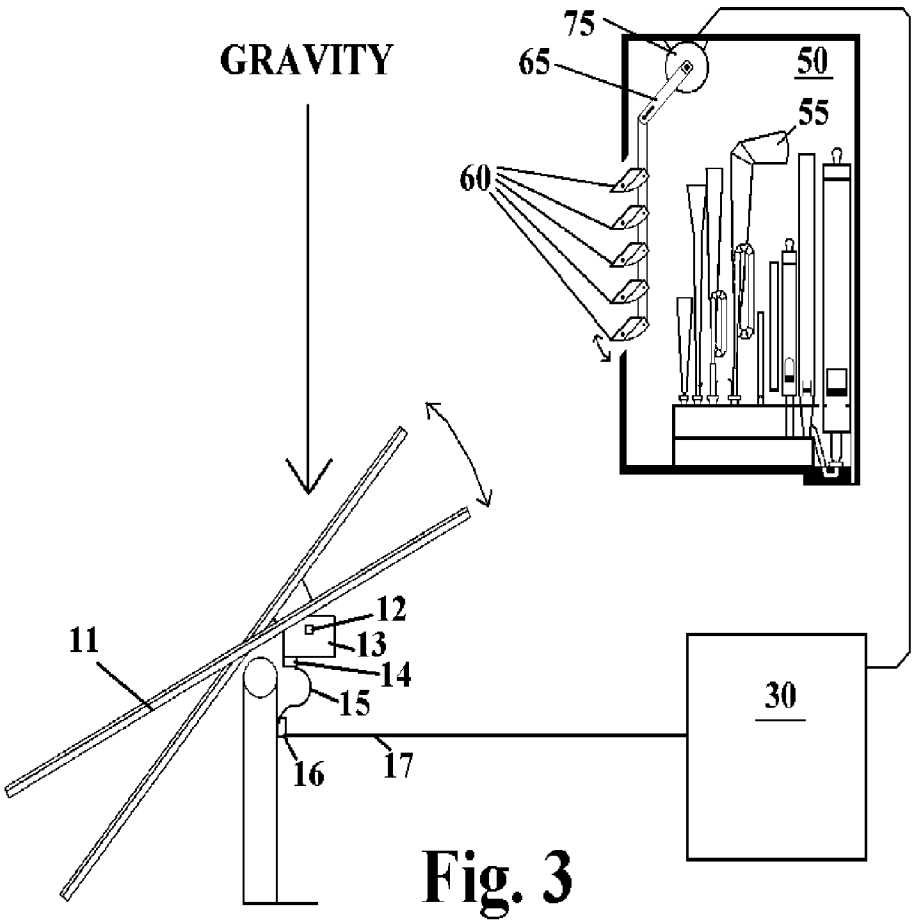
FIG. 3 shows a swell-pedal to which is affixed gravimeter circuitry comprising an analog accelerometer.

FIG. 3 shows a less expensive, and preferred, swell pedal according to this invention. A swell pedal 11 of an organ comprises a gravimeter circuit board 13, upon which is mounted an accelerometer 12, used as a gravimeter sensor to provide an analog output signal. Gravimeter circuit board 13 also bears a connection anchor 14. Attached to the connection anchor 14 is a flexible printed circuit cable 15 arranged in a loop to accommodate the approximately 22 degree angular rotation of swell pedal 11. In practice this loop might be made proportionally larger than shown to reduce stress on cable 15. Another connection anchor 16 is attached to a point fixed to the organ console that comprises pedal 11. As pedal 11 is depressed by the organist's foot, the angle of accelerometer 12 relative to the force of the earth's gravity is changed, causing a signal generated by accelerometer 12 to change responsive to the angle of pedal 11. This signal processed through gravimeter circuit board 13 and conveyed through cables 15 and 17 to relay 30, which in turn operates either swell shades 60, or their equivalent in a virtual organ. Gravimeter circuit board 13 emulates signals previously provided by a prior-art potentiometers and swell rollers. Using accelerometer 12 provides advantages over prior-art pedal angle sensors. It is unaffected by dirt. No complex, wear-sensitive linkage is required. The flexible cable 15, preferably a flexible printed circuit type flat cable, provides a mechanically simple electrical connection in a way already proven durable in many thousands of document scanners. Unlike mechanical linkages and potentiometers, gravimeter circuit board 13 is easy to adjust electrically for both angle and sensitivity without loss of resolution, as will be discussed below.

Figure 4:
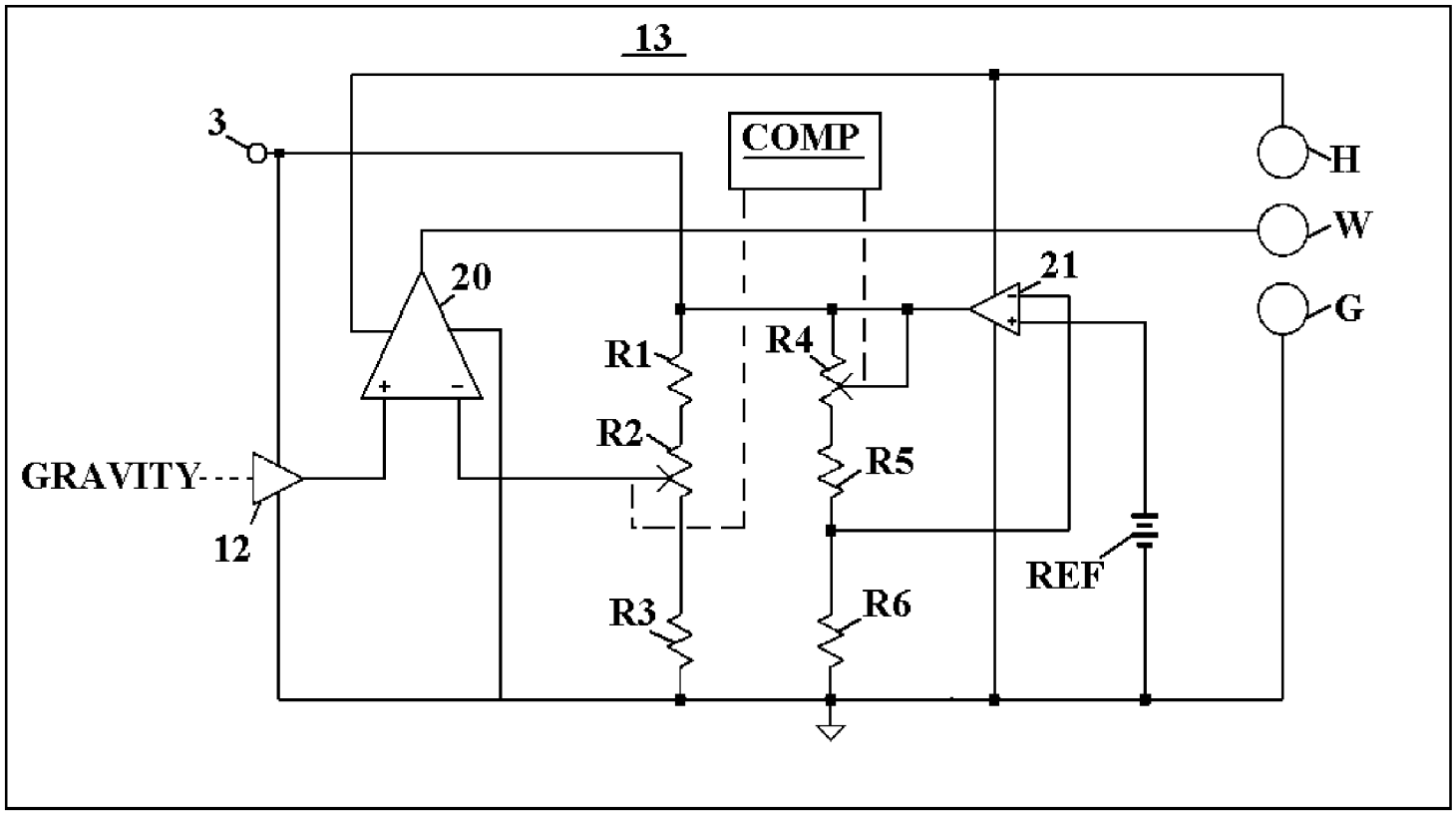
FIG. 4 is a schematic diagram of analog circuitry comprised by a gravimeter circuit card mechanically depicted in FIG. 3.

FIG. 4 is a schematic diagram of gravimeter circuit board 13 having been mechanically depicted in FIG. 3. An accelerometer 12 with analog processing circuitry reside upon gravimeter circuit board 13 of this embodiment of the present invention. Accelerometer 12 is preferably ST Microelectrics part number LIS332AR, a micro-machined, integrated-circuit accelerometer, only the X-axis output of which is used in this embodiment. Its nominal power supply voltage is 3.0 volts, at which voltage it typically puts out a change of about 225 mV for an angular change of 22 degrees. Its output is ratiometrically related to its power supply voltage. When its X-axis is parallel to the earth surface the output of accelerometer 12 is about ½ its supply voltage, typically about 1.5 volts.

The output of accelerometer 12 is applied to a plus input of an instrumentation amplifier 20 having a gain of about 22. To a minus input of instrumentation amplifier 20 is applied a voltage of about 1.5 volts. As the musician depresses the swell pedal 11 of FIG. 3 though an angle of about 22 degrees, the output of accelerometer 12 varies from about 1.5 to about 1.725 volts. Instrumentation amplifier 20 amplifies this voltage change and also refers it to ground, causing the analog output voltage at terminal W to vary from about 0 volts to nearly 5 volts, with reference to terminal G. To terminal H is applied a supply voltage of about 5 volts. Thus with no angle-sensing potentiometer, and with no complex mechanical linkage between it and swell pedal 11, gravimeter circuit board 13 can emulates the function of prior-art potentiometers or rheostats, or of swell rollers, terminals H, W, and G corresponding to the High, Wiper, and Ground of prior-art potentiometers. These terminals of this embodiment may be connected to relay 30 as shown in FIG. 3, just as prior-art swell pedal potentiometers were previously connected, to perform the same organ console function.

DETAILED DESCRIPTION OF THE INVENTION

In this embodiment, accelerometer 12 is powered by a regulator comprising an ordinary operational amplifier 21, responsive to a 1.21 volt reference REF, scaled by a voltage divider comprising resistors R4 through R6. By adjusting resistor R4, a 3V power node 3 can be adjusted about +/−5%. Since accelerometer 12 operates ratiometrically, resistor R4 provides easy electronic control of the sometimes non-ideal angular sensitivities of individual units of accelerometer 12 to provide a standardized analog output voltage swing for 22 degrees of angular change of swell pedal 11 of FIG. 3 upon which gravimeter circuit board 13 and accelerometer 12 ride.

This embodiment also comprises a voltage divider R1 through R3 which provides, from potentiometer R2, the aforementioned voltage applied to the minus input of instrumentation amplifier 20. Variation of individual accelerometers 12 may cause them, when level, to output voltages slightly different from the ideal 1.5 volts. Also an organ console comprising swell pedal 11 of FIG. 3 and circuit board 13 may not be perfectly level. Potentiometer R2 provides electronic leveling adjustment for easy removal of such imperfections, to provide a signal representing a perfectly level condition when swell pedal 11 of FIG. 3 is not depressed.

Thus resistor R4 and potentiometer R2 provide a convenient means of making adjustments that would have been accomplished mechanically in prior-art swell pedal apparatus. Unlike prior-art mechanical adjustments, since resistor R4 and potentiometer R2 are used only for setup, and not as angle sensors, the electrical adjustments of this embodiment are not subject to mechanical wear as swell pedal 11 of FIG. 3 is exercised.

FIG. 4 also depicts the optional control of resistor R4 and potentiometer R2 by a computer COMP. Such control may be easily accomplished by using well-known digital potentiometers instead of manually operated devices for resistor R4 and potentiometer R2. Such digital potentiometers often include well known I2C or SPI serial interfaces to facilitate computer control. Along with any analog circuits, a serial link for such interfaces may easily be connected through a flexible cable such as cable 15 of FIG. 3. If such optional computer setup is chosen, adjustments formerly performed mechanically, often with considerable inconvenience, may be performed by computer without even opening an organ console. The LIS332AR is but one of many accelerometers that could be analogously applied to embody the present invention.

Figure 5:
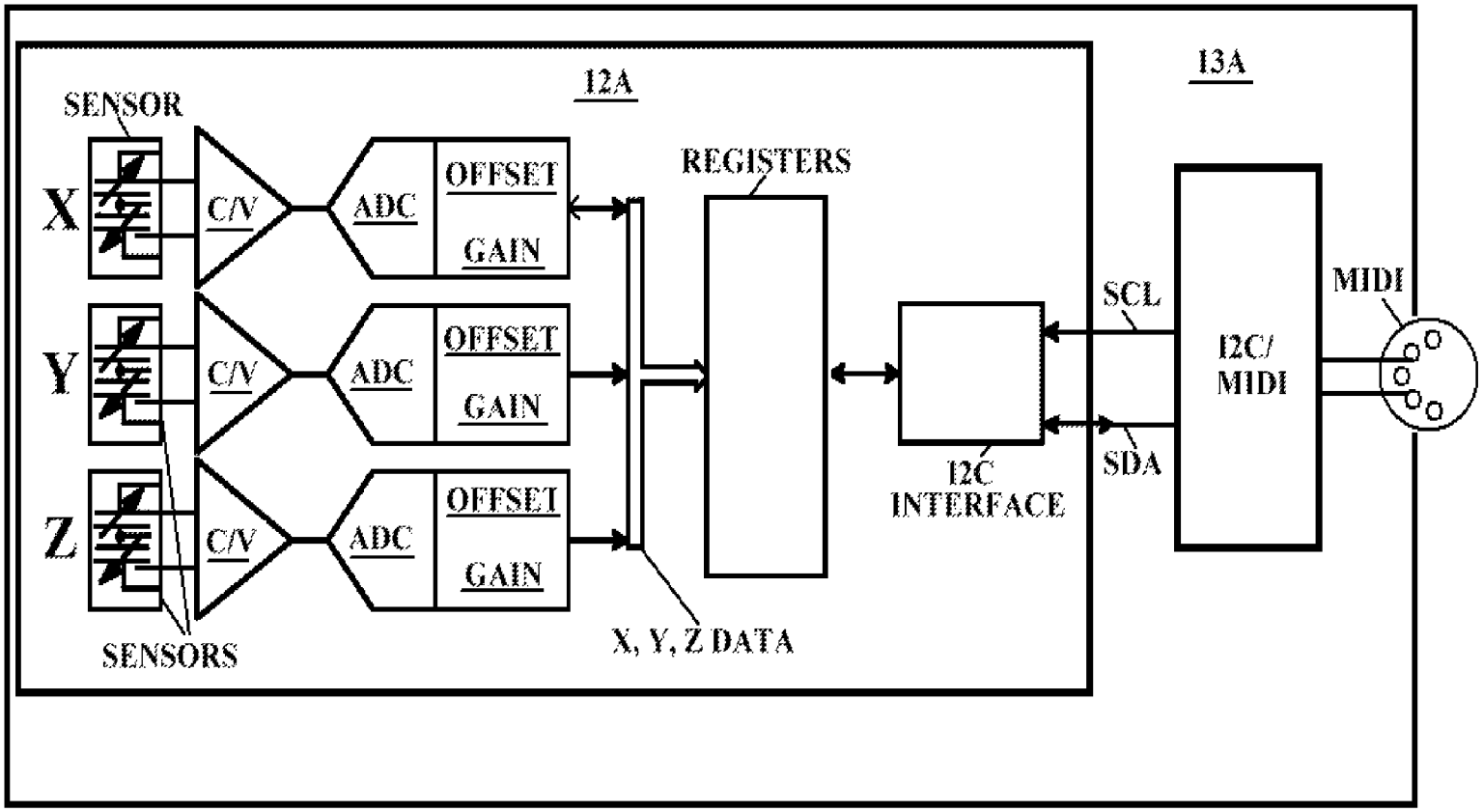
FIG. 5 shows a swell-pedal to which is affixed gravimeter circuitry comprising an digital accelerometer.

FIG. 5 depicts an alternative embodiment of the present invention wherein a gravimeter circuit card 13A, bearing an accelerometer 12A, preferably mCube part number MC3430, a micro-machined, integrated-circuit accelerometer, may be mounted to a pedal just as gravimeter circuit card 13 of FIG. 3 is mounted to pedal 11 of that figure. Accelerometer 12A senses pedal angle relative to the earth's gravity just as does accelerometer 12 of FIG. 3, as is explained in the teaching of FIG. 3 above.

Accelerometer 12A is like accelerometer 12 in having X, Y, and Z sensors and capacitance to voltage converters C/V, here illustrated. Beyond that commonality, accelerometer 12A is different from accelerometer 12 of FIG. 3 in that it is endowed with analog to digital converters ADC, offset and gain adjusters OFFSET GAIN, digital memory REGISTERS, and a serial digital interface I2C INTERFACE. Instead of outputting the FIG. 3 analog signals of accelerometer 12 responsive to pedal angle, accelerometer 12A generates digital output signals responsive to angle that are stored in memory REGISTERS for transmission through interface I2C INTERFACE out of data line SDA, synchronized by clock line SCL. Thus gravimeter circuit board 13A provides a digital output signal. Some of the registers of memory REGISTERS of accelerometer 12A are devoted to storing data wherewith to adjust adjusters OFFSET GAIN. Performing such adjustments corresponds to setting potentiometer R2 and resistor R4 of FIG. 4 to adjust level and angular sensitivity respectively. The memory REGISTERS may be accessed through lines SDA and SCL.

Gravimeter circuit card 13A also bears an interface I2C to MIDI that produces a digital MIDI output signal at output MIDI responsive to the data transmitted through line SDA, which, in turn, is ultimately responsive to pedal angle. If interface I2C TO MIDI be fitted with optional extra circuitry and additional MIDI lines, the memory REGISTERS may, through that interface, receive digital MIDI data be written therein to adjust level and angular sensitivity, replacing often-troublesome prior-art linkage adjustments. The mCube MC3430 is but one of many accelerometers suitable for the function described for this figure. The MIDI protocol is presently the most common protocol for musical applications, but USB is increasingly supplanting MIDI in this area. The present invention can be practiced and using MIDI, USB, or one or more of many other protocols.

Figure 6:
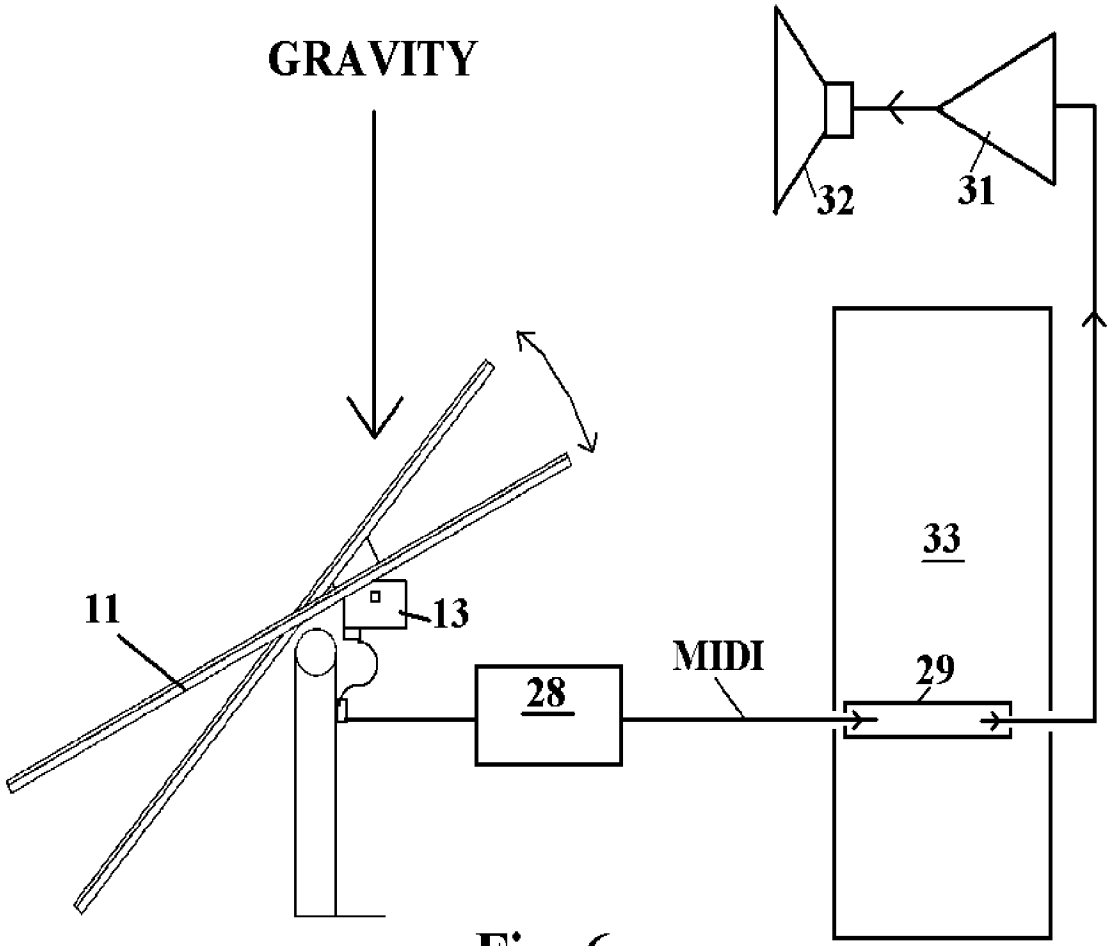
FIG. 6 depicts a virtual pipe organ comprising a swell pedal according to the present invention.

FIG. 6 shows a swell or expression pedal 11 fitted with a gravimeter circuit card according to FIG. 4 applied to a virtual organ. Gravimeter circuit card 13 connects to a MIDI encoder 28 designed to be responsive to a prior-art potentiometer. The Highly_Liquid model MIDI CPU has been successfully used for this encoding task. A MIDI output of the encoder connects to a MIDI input of a sound card 29 that resides in a personal computer 33. In this same personal computer 33 typically resides the software application of the virtual organ along with digital files representing organ pipe sounds. Computer 33 may be a computer similar or identical to that comprised by relay 30 of FIGS. 1B and 3. An audio output of sound card 29 typically drives the input of an audio power amplifier 31, which in turn drives one or more loudspeakers 32 to produce the sounds of organ pipes. Digital sample files of sounds of other instruments such as pianos, harpsichords, vibraphones, marimbas, and other musical sounds may also reside in computer 30 and may be likewise played.

Figure 7:
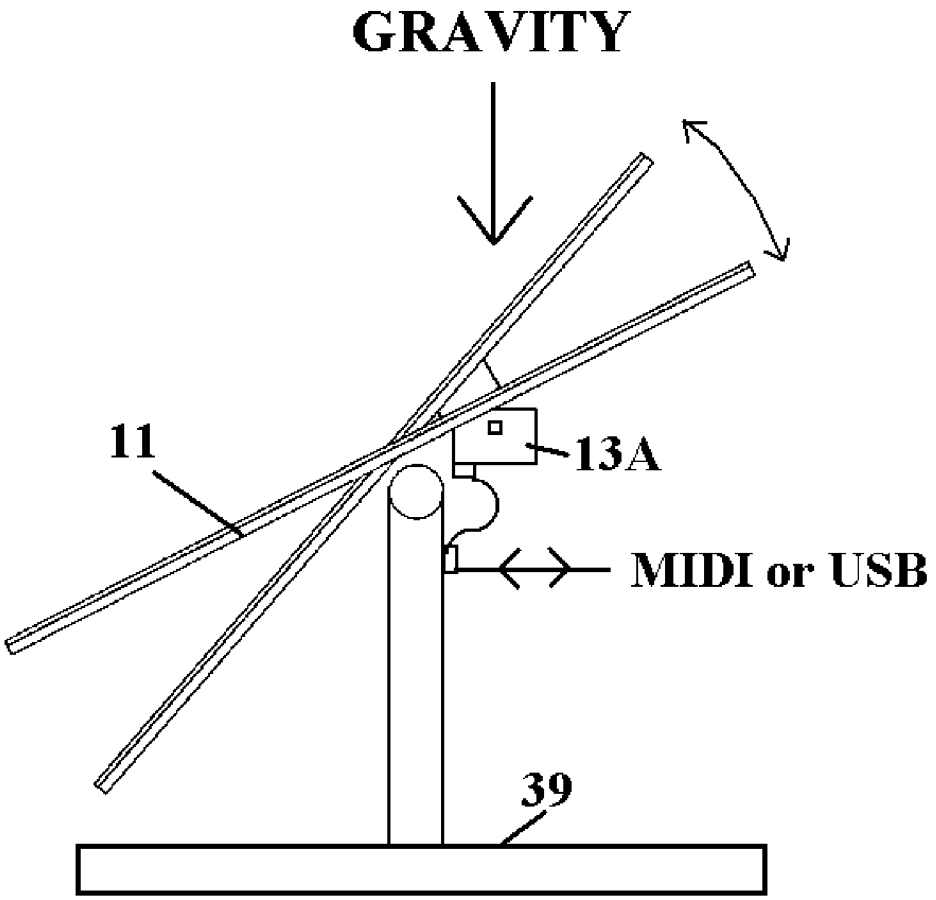
FIG. 7 shows a free-standing expression pedal according to the present invention suitable for use with musical instruments other than organs.

FIG. 7 shows an expression pedal 11 fitted with the circuit board 13A of FIG. 5 mounted on a base 39. This is a free-standing expression pedal usable with numerous assemblages of electronic musical instruments too varied to be considered in this teaching. This free standing expression pedal might be most commonly adapted to communicate using a MIDI protocol, but USB and other protocols are also practical to practice this invention.

What is claimed is:

1. A swell, expression, or crescendo pedal for a musical instrument comprising a gravimeter for sensing the angular position of the pedal relative to the earth's gravity and for providing a signal for controlling the musical instrument responsive to that angular position to control a musical effect of the musical instrument responsive to that angular position, wherein the gravimeter comprises circuitry that emulates the function of a potentiometer or rheostat.

2. A swell, expression, or crescendo pedal for a musical instrument comprising a gravimeter for sensing the angular position of the pedal relative to the earth's gravity and for providing a signal for controlling the musical instrument responsive to that angular position to control a musical effect of the musical instrument responsive to that angular position, wherein the gravimeter comprises circuitry to provide electronic leveling of the gravimeter.

3. A swell, expression, or crescendo pedal according to claim 2 wherein the electronic leveling of the gravimeter is responsive to digital signals from a computer.

4. A swell, expression, or crescendo pedal for a musical instrument comprising a gravimeter for sensing the angular position of the pedal relative to the earth's gravity and for providing a signal for controlling the musical instrument responsive to that angular position to control a musical effect of the musical instrument responsive to that angular position, wherein the gravimeter comprises circuitry to provide electronic control of angular sensitivity of the gravimeter.

5. A swell, expression, or crescendo pedal according to claim 4 wherein the electronic control of angular sensitivity of the gravimeter is responsive to digital signals from a computer.

* * * * *